US011011113B1

(12) United States Patent
Lu et al.

(10) Patent No.: US 11,011,113 B1
(45) Date of Patent: May 18, 2021

(54) TFT PIXEL THRESHOLD VOLTAGE COMPENSATION CIRCUIT WITH GLOBAL COMPENSATION

(71) Applicant: Sharp Kabushiki Kaisha, Osaka (JP)

(72) Inventors: Tong Lu, Oxford (GB); Michael James Brownlow, Oxford (GB); Tim Michael Smeeton, Oxford (GB)

(73) Assignee: Sharp Kabushiki Kaisha, Osaka (JP)

( * ) Notice: Subject to any disclaimer, the term of this patent is extended or adjusted under 35 U.S.C. 154(b) by 0 days.

(21) Appl. No.: 16/830,876

(22) Filed: Mar. 26, 2020

(51) Int. Cl.
*G09G 3/3258* (2016.01)
*G09G 3/3266* (2016.01)
*G09G 3/325* (2016.01)
*G09G 3/3283* (2016.01)

(52) U.S. Cl.
CPC ..... *G09G 3/325* (2013.01); *G09G 3/3283* (2013.01); *G09G 2310/0294* (2013.01); *G09G 2320/0204* (2013.01); *G09G 2320/0233* (2013.01)

(58) Field of Classification Search
CPC .. G09G 3/3258; G09G 3/3266; G09G 3/3233; G09G 2300/0819; G09G 2310/0251; G09G 2320/045; G09G 3/325; G09G 3/3283; G09G 2320/0204; G09G 2320/0233; G09G 2310/0294
See application file for complete search history.

(56) References Cited

U.S. PATENT DOCUMENTS 7,414,599 B2 8/2008 Chung et al.
8,830,219 B2 9/2014 Choi et al.
9,269,297 B2 2/2016 Kanda et al.
10,223,964 B2 3/2019 Han
2012/0019501 A1* 1/2012 Choi ..... G09G 3/3233 345/211
2015/0062193 A1* 3/2015 Kanda ..... G09G 3/3291 345/690
2016/0203759 A1* 7/2016 Han ..... G09G 3/3233 345/212
2018/0233085 A1* 8/2018 Wang ..... G09G 3/3233

* cited by examiner

*Primary Examiner* — Md Saiful A Siddiqui
(74) *Attorney, Agent, or Firm* — Renner, Otto, Boisselle & Sklar, LLP

(57) ABSTRACT

A pixel circuit compensates the threshold voltage variations of the drive transistor with an ultra-short one horizontal (1H) time, with additionally removing the possible memory effects associated with the light-emitting device and the drive transistor from the previous frame. An ultra-short 1H time (<2 μs) is achieved via separation of threshold compensation of the drive transistor and data programming phases. The pixel circuit has a two-capacitor configuration, whereby a first capacitor is used for drive transistor threshold compensation, and a second capacitor is used to store the data voltage during a data pre-loading phase. Two transistors are employed to electrically connect the gate and source of the drive transistor to a common initialization voltage during an initialization phase to reset circuit voltages for the current frame. In this manner, no current flows through the drive transistor to the light-emitting device during the initialization phase when the light-emitting device does not emit light, which saves power. An array of individual pixel circuits is controlled using a global compensation scheme in which global control signals are applied to the individual pixel circuits of the pixel array.

10 Claims, 5 Drawing Sheets

TFT PIXEL THRESHOLD VOLTAGE COMPENSATION CIRCUIT WITH GLOBAL COMPENSATION

TECHNICAL FIELD

The present invention relates to design and operation of electronic circuits for delivering electrical current to an element in a display device, such as for example to an organic light-emitting diode (OLED) in the pixel of an active matrix OLED (AMOLED) display device.

BACKGROUND ART

Organic light-emitting diodes (OLED) generate light by re-combination of electrons and holes, and emit light when a bias is applied between the anode and cathode such that an electrical current passes between them. The brightness of the light is related to the amount of the current. If there is no current, there will be no light emission, so OLED technology is a type of technology capable of absolute blacks and achieving almost "infinite" contrast ratio between pixels when used in display applications.

Several approaches are taught in the prior art for pixel thin film transistor (TFT) circuits to deliver current to an element of a display device, such as for example an organic light-emitting diode (OLED), through an n-type drive transistor. In one example, an input signal, such as a "SCAN" signal, is employed to switch transistors in the circuit to permit a data voltage, VDAT, to be stored at a storage capacitor during a programming phase. When the SCAN signal is low and the switch transistors isolate the circuit from the data voltage, the VDAT voltage is retained by the capacitor and this voltage is applied to a gate of a drive transistor. With the drive transistor having a threshold voltage $V_{TH}$, the amount of current to the OLED is related to the voltage on the gate of the drive transistor by:

$$I_{OLED} = \frac{\beta}{2}(V_{DAT} - V_{OLED} - V_{TH})^2$$

where $V_{OLED}$ is a voltage between the anode of the OLED and an ELVSS power supply for the pixel.

TFT device characteristics, especially the TFT threshold voltage $V_{TH}$, may vary with time or among comparable devices, for example due to manufacturing processes or stress and aging of the TFT device over the course of operation. With the same VDAT voltage, therefore, the amount of current delivered by the drive TFT could vary by a large amount due to such threshold voltage variations. Therefore, pixels in a display may not exhibit uniform brightness for a given VDAT value.

Conventionally, therefore, OLED pixel circuits have high tolerance ranges to variations in threshold voltage and/or carrier mobility of the drive transistor by employing circuits that compensate for mismatch in the properties of the drive transistors. For example, an approach is described in U.S. Pat. No. 7,414,599 (Chung et al., issued Aug. 19, 2008), which describes a circuit in which the drive TFT is configured to be a diode-connected device during a programming period, and a data voltage is applied to the source of the drive transistor.

The threshold compensation time is dictated by the drive transistor's characteristics, which may require a long compensation time for high compensation accuracy. For the data programming time, the RC constant time required for charging the programming capacitor is determinative of the programming time. As is denoted in the art, the one horizontal (1H) time is the time that it takes for the data to be programmed for one row.

With such a circuit configuration as in U.S. Pat. No. 7,414,599, the data is programmed at the same time as when the threshold voltage of the drive transistor is compensated. It is desirable, however, to have as short of a one horizontal time as possible to enhance the responsiveness and operation of the display device. This is because each row must be programmed independently, whereas other operations, such as for example drive transistor compensation, may be performed for multiple rows simultaneously. The responsiveness of the display device, therefore, tends to be dictated most by the one horizontal time for data programming. When the data is programmed during the same operational phase as the drive transistor is compensated, the one horizontal time cannot be reduced further due to compensation accuracy requirements for the drive transistor, as the compensation requirements limit any time reductions for the programming phase. A different approach needs to be employed to have a short one horizontal time.

As well as fast response time, a display device sometimes shows a static image such as a screen saver, logo, or the like. When displaying such a static image, often such image needs to be displayed or retained for a substantially longer period of time as compared to a dynamic image. For saving power consumption, especially as to a battery powered device such as a mobile communication device or other portable computing device, it may desirable to have a lower frame refresh rate. Oxide thin film transistors, such as IGZO (indium gallium zinc oxide) transistors, have ultra-low leakage when in the off state. When using an IGZO transistor as a data switch device, the leakage through the data switch device is ultra-low, and thus the pixel circuit can retain the data voltage at the gate of the drive transistor for a substantially longer time. With using an IGZO transistor as the data switch device, the frame refresh rate can be reduced to save power consumption.

A global compensation scheme, whereby an entire display panel of pixels can be compensated simultaneously, can be used to separate drive transistor compensation from data programming. With a global compensation scheme, the data is pre-loaded to the pixel row by row, and then all the pixels in the display panel are compensated at the same time. Compared to a conventional row-by-row compensation scan, the control signals for a global compensation scheme are the same for each of the rows being compensated simultaneously. The use of a global compensation scheme simplifies the panel driver design and saves power consumption for the logic generation circuits.

One approach for a global compensation scheme in described in U.S. Pat. No. 8,830,219 (Choi, issued Sep. 9, 2009). In such circuit, two global control signals and a power supply ELVDD change to a state resetting all the pixels in the panel. Then the data is programmed row by row to each pixel, and global threshold compensation follows the row-by-row data programming. After global compensation, the global control signals enable the emission for all the pixels in the panel. A short one horizontal time can be achieved as the programming time is independent of the compensation time, but this scheme has a compensation mismatch between rows as the compensation time is different for each row. In particular, the first row has the longest compensation time and the last row has the shortest compensation time, and this variation can result in latter rows being inadequately compensated.

Another global compensation approach is described in U.S. Ser. No. 10/223,964 (Han, issued Mar. 5, 2019). In such configuration, data is pre-loaded to a hold capacitor in each pixel row by row by a scan signal. After the data is loaded for all the pixel on each rows, a global reset signal is applied to all the pixels, and the data stored on the hold capacitor is applied to the gate of the drive transistor in each pixel by a global writing signal. During the same time, the difference between the data voltage and the threshold voltage of drive transistor is obtained at the source of the drive transistor and stored in a storage capacitor. Then the stored voltage is applied to the gate and source of the drive transistor during the emission phase. In this way the data voltage is programmed to the pixel and the threshold voltage of the drive transistor is compensated. The data holding time on the hold capacitor can be as long as the emission time, but the described configuration does not recognize issues associated with off-state transistor leakage. Accordingly, leakage through the described TFT components could degrade the data voltage on the hold capacitor over time. As a result, the same data voltage stored on the hold capacitors for the first row and last row could have a significant difference due to the leakage. A second issue with this scheme is the timing of the global signals, especially the voltage supplies ELVDD and ELVSS. There could be a large surging current at the supply lines when the signals for all the pixels change at the same time, and this large surge current could cause a large IR drop which undermines performance.

Another global compensation approach is described in U.S. Pat. No. 9,269,297 (Kanda, issued Feb. 23, 2016). In such configuration, data is pre-loaded to a hold capacitor in each pixel row by row by a scan signal. After the data is loaded on all the rows, two global control signals and a global emission signal change to states resetting all the pixels in the panel. Then data is transferred from the hold capacitor to the gate of the drive transistor, and the threshold compensation is performed at the same time. In the latter emission phase, all the pixels emit light at the same time. The next image data is loaded to a hold capacitor in each pixel row by row again during the emission phase. In this way, there is no compensation mismatch due to compensation time differences, and there is no large supply current from the ELVDD and ELVSS. This OLED current still could be negatively affected by data leakage issues during pre-loading. The global emission signals have two pulses, one long pulse and one short pulse, and this dual pulse operation could be difficult to implement or could require more area in the panel to generate this operation of pulses.

SUMMARY OF INVENTION

The present invention relates to pixel circuits that are capable of compensating the threshold voltage variations of the drive transistor with an ultra-short one horizontal time 1H of less than about 2 μs, which is shorter as compared to conventional configurations, with additionally removing the possible memory effects associated with the light-emitting device and the drive transistor from the previous frame. An ultra-short 1H time (<2 μs) is achieved via separation of threshold compensation of the drive transistor and data programming phases. The threshold compensation time is decided by the drive transistor characteristics and is difficult to reduce further without degrading the compensation accuracy. By separating the threshold compensation and data programming phases, a longer time can be allocated to threshold compensation for compensation accuracy while maintaining a short 1H time. As referenced above, the RC constant time required for charging the programming capacitor is determinative of the programming time, and such programming time can be reduced to ultra-short 1H times (<2 μs).

To achieve such results, a two-capacitor pixel circuit configuration is used, whereby a first capacitor is used for drive transistor threshold compensation, and a second capacitor is used to store the data voltage during a data pre-loading phase. The threshold compensation and data programming operations are independent of each other, and thus a short one horizontal time can be achieved by employing a short data programming phase.

Embodiments of the present application also use an ultra-low leakage oxide transistor, such as an IGZO transistor, as the data switch device, and this permits the stored data voltage to be retained longer on the second capacitor due to ultra-low leakage of the IGZO device. A conventional typical refresh rate is 60 Hz. By using an IGZO transistor as the data switch device, the refresh rate can be reduced to 30 Hz or lower for static images. With a lower refresh rate, the power consumption in turn is reduced.

Embodiments of the present application also use a dual transistor configuration to electrically connect the gate and source of the drive transistor to a common initialization voltage during an initialization phase to reset circuit voltages for the current frame. An initialization voltage is applied to a mid node connection of the dual transistor configuration, with the initialization voltage being set such that the gate-source voltage of the drive transistor places the drive transistor in an off state. In this manner, no current flows through the drive transistor to the light-emitting device during the initialization phase when the light-emitting device does not emit light, which saves power.

Embodiments of the present application may be operated using an external global compensation scheme, whereby data is pre-loaded row by row by a SCAN signal during a previous frame emission phase. Multiple rows, up to all rows of pixels are controlled by global control signals for an initialization phase, a data transfer and threshold compensation phase, and an emission phase. The threshold voltage variations of the drive transistors are compensated for multiple pixels up to all the pixels in whole panel by the external global compensation scheme.

An aspect of the invention, therefore, is a pixel circuit for a display device that is configured to place the drive transistor in an off state during initialization for power saving, while still isolating the data programming phase from the compensation phase for a shorter 1H as compared to conventional configurations combined with effective drive transistor threshold voltage compensation. In exemplary embodiments, the pixel circuit includes a drive transistor configured to control an amount of current to a light-emitting device during an emission phase depending upon a voltage applied to a gate of the drive transistor, wherein a threshold voltage of the drive transistor is compensated during a threshold compensation phase, and a first terminal of the drive transistor is connected to a first power supply line that supplies a driving voltage; wherein the light-emitting device is electrically connected at a first node to a second terminal of the drive transistor during the emission phase, and at a second node to a second power supply line; a first switch transistor having a first terminal connected to the gate of the drive transistor, and a second terminal connected to an initialization voltage supply line that supplies an initialization voltage during an initialization phase;

and a second switch transistor having a first terminal connected to a second terminal of the drive transistor, and a second terminal connected to the initialization voltage supply line and the second terminal of the first switch transistor.

In exemplary embodiments, the pixel circuit further may include a data holding capacitor having a first plate that is electrically connectable to the gate of the drive transistor, and a second plate connected to a reference voltage supply line that supplies a reference voltage; a storage capacitor having a first plate connected to the second terminal of the drive transistor and the first terminal of the second switch transistor, and a second plate that is electrically connectable to the gate of the drive transistor; a third switch transistor having a first terminal connected to the gate of the drive transistor and the first terminal of the first switch transistor, and a second terminal connected to the second plate of the storage capacitor; a fourth switch transistor having a first terminal connected to the second plate of the storage capacitor and the second terminal of the third switch transistor, and a second terminal connected to a second reference voltage supply line that supplies the reference voltage; a fifth switch transistor having a first terminal connected to the first plate of the data holding capacitor, and a second terminal connected to a data voltage supply line that supplies a data voltage; a sixth switch transistor having a first terminal connected to the first plate of the data holding capacitor, and a second terminal connected to the gate of the drive transistor, the first terminal of the first switch transistor, and the first terminal of the third switch transistor; and a seventh switch transistor having a first terminal connected to the first node of the light-emitting device, and a second terminal connected to the second terminal of the drive transistor and the first plate of the storage capacitor.

Another aspect of the invention is a method of operating a display panel including a pixel circuit according to any of the embodiments to place the drive transistor in an off state during initialization for power saving, while still isolating the data programming phase from the compensation phase for a shorter 1H as compared to conventional configurations combined with effective drive transistor threshold voltage compensation. In exemplary embodiments, the method of operating the display panel includes the steps of providing a pixel circuit according to any of the embodiments; performing a data pre-loading phase comprising electrically connecting the data holding capacitor to a data voltage supply line that supplies a data voltage to pre-load the data voltage onto the data holding capacitor; performing an initialization phase comprising: placing the first switch transistor in an on state to apply the initialization voltage to the gate of the drive transistor through first switch transistor, and placing the second switch transistor in an on state to apply the initialization voltage to the second terminal of the drive transistor through the second switch transistor, wherein the drive transistor is in an off state when the initialization voltage is applied to the gate and second terminal of the drive transistor; at the end of a first portion of the initialization phase, electrically disconnecting the second plate of the storage capacitor from the gate of the drive transistor and electrically disconnecting the first node of the light-emitting device from the second terminal of the drive transistor; and during a second portion of the initialization phase, applying the reference voltage to the second plate of the storage capacitor; performing a data transfer and threshold compensation phase comprising transferring the data voltage from the data holding capacitor to the gate of the drive transistor, and storing a threshold voltage of the drive transistor at the first plate of the storage capacitor; and performing the emission phase during which light is emitted from the light-emitting device by electrically connecting the second terminal of the drive transistor to the first node of the light emitting device, and electrically connecting the second plate of the storage capacitor to the gate of the drive transistor.

Individual pixel circuits may be incorporated into a display panel that includes a pixel array comprising a plurality of individual pixel circuits arranged in "n" rows by "m" columns, and "n" and "m" are integers greater than one, wherein each of the individual pixel circuits in the pixel array is configured according to any of the embodiments. The individual pixel circuits may be controlled in accordance with a group or global compensation scheme in which global control signals are applied to multiple individual pixel circuits (up to all individual pixel circuits) of the pixel array. SCAN signals may be applied on a row by row basis to sequentially electrically connect the data holding capacitors of the individual pixel circuits to the voltage data lines on the row by row basis to pre-load a respective data voltage onto the data holding capacitors during the data pre-loading phase.

To the accomplishment of the foregoing and related ends, the invention, then, comprises the features hereinafter fully described and particularly pointed out in the claims. The following description and the annexed drawings set forth in detail certain illustrative embodiments of the invention. These embodiments are indicative, however, of but a few of the various ways in which the principles of the invention may be employed. Other objects, advantages and novel features of the invention will become apparent from the following detailed description of the invention when considered in conjunction with the drawings.

DESCRIPTION OF EMBODIMENTS

Figure 1:
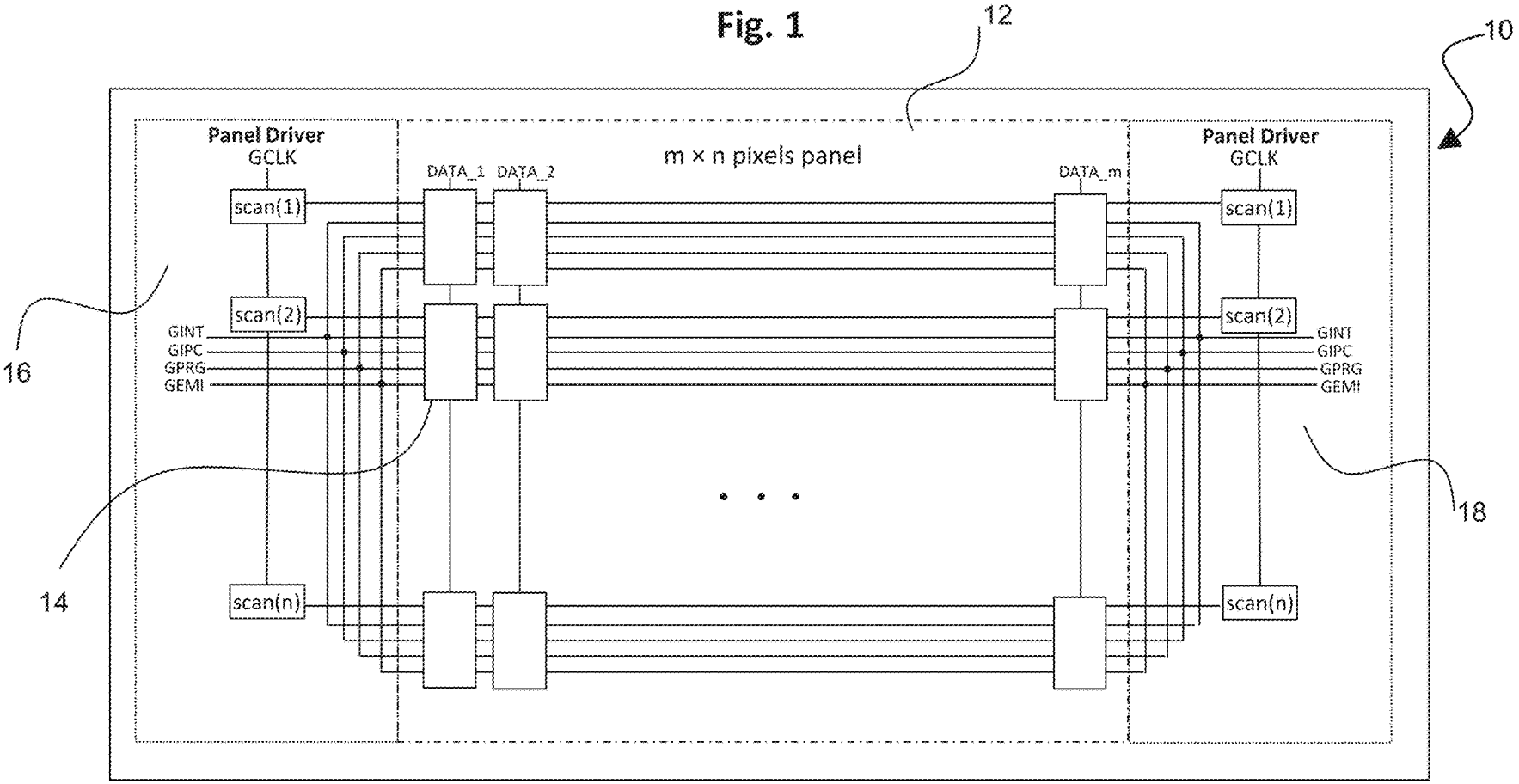
FIG. 1 is a drawing depicting a display panel with "n" rows and "m" columns of individual pixels, and a panel driver configuration that operates using a global compensation scheme.

Embodiments of the present application will now be described with reference to the drawings, wherein like reference numerals are used to refer to like elements throughout. It will be understood that the figures are not necessarily to scale.

FIG. 1 is a drawing depicting a display panel configuration 10 in accordance with embodiments of the present application. The display panel 10 includes a pixel array 12 of "n" rows and "m" columns of individual pixels 14, and panel drivers 16 and 18 located respectively on the left and right edges of the display panel 10 on opposite sides of the pixel array 12. The panel drivers 16 and 18 operate comparably as each other in applying comparable control signals as further detailed below. Multiple panel drivers are used to prevent signal degradation across the display panel, and applying control signals from panel drivers on opposite sides of the pixel array 12 ensures effective control signals are received by the individual pixels with less dependency on the location on the display panel.

Each individual pixel 14 is located at the intersection of scan control lines and the data input lines. The data input lines are arranged by column, i.e., there are "m" columns of data input lines (Data_1, Data_2, . . . Data_m) associated with a corresponding "m" data signals that respectively are connected to the pixels in each column via one data line. The scan control lines are arranged by row, i.e., there are "n" rows of scan control lines (scan(1), scan(2), . . . scan(n)) associated with a corresponding "n" scan control signals that respectively are connected to the pixels in each row via one scan control line. The scan control signals perform a row selection function, whereby when a scan line in a row is enabled, the data is written to the pixels in that row.

Referring to the panel drivers 16 and 18, the pixels in each row are also connected to four group or global control signal lines, GINT, GIPC, GPRG and GEMI ("G" denoting a group or global control line), configured to implement a global compensation scheme for compensating a threshold voltage of the drive transistors of the individual pixel circuits 14. To implement a global compensation scheme, the global control signals GINT, GIPC, GPRG and GEMI, are applied to multiple pixels simultaneously up to all the pixels of the whole pixel panel 12.

The various control signal input lines are used to operate the individual pixels 14 in different phases. Generally, the pixels are operated in four phases, including a data pre-loading phase, an initialization phase, a combined data transfer and threshold compensation phase, and an emission phase. The data pre-loading phase occurs during the previous frame emission phase. As further detailed below (further in connection with FIG. 2), the GINT signal is enabled during the initialization phase; the GIPC signal is enabled during a second or latter portion of the initialization phase and during the data transfer and threshold compensation phase; the GPRG signal is enabled during the data transfer and threshold compensation phase; and the GEMI signal is enabled during a first or early portion of the initialization phase and during the emission phase. The pixel circuit control during each phase is described in more detail below.

Referring back to FIG. 1, a gate clock signal input line, GCLK, from a driver integrated circuit (IC) is input to the panel drivers 16 and 18. The gate clock signal is used to generate the scan signals for each row.

Figure 2:
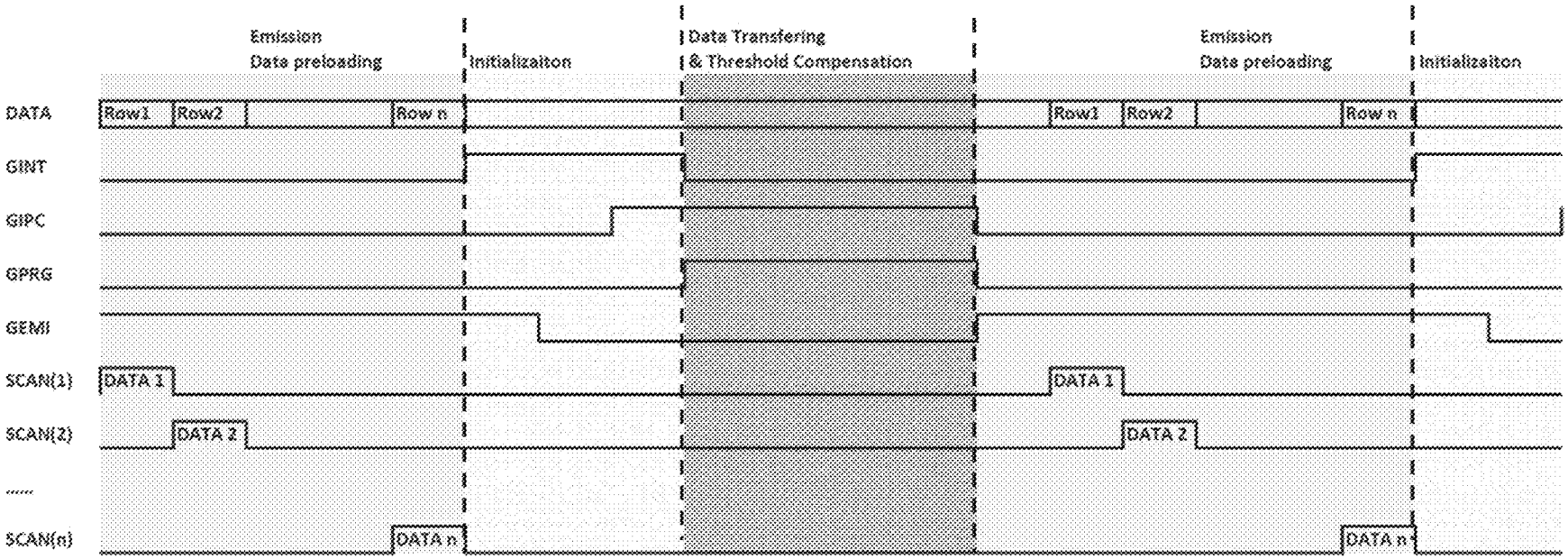
FIG. 2 is a drawing depicting a timing diagram for global compensation that is employed in the display panel of FIG. 1.

FIG. 2 is a drawing depicting a timing diagram for global compensation that is employed in the pixel panel 10 of FIG. 1. As representative, the timing diagram of FIG. 2 illustrates the scan signals SCAN, and the global control signals GINT, GIPC, GPRG, and GEMI. "DATA" is the data signal that is applied to the pixel columns, and for illustration FIG. 2 shows timing for only one column data signal. In the whole panel, there are "m" columns of data signals applied respectively to the "m" columns of pixels. In one column, there are "n" rows of pixels. "SCAN (1)" is the scan signal for the first row, "SCAN (2)" is the scan signal for the second row, and so on with "SCAN (n)" being the scan signal for an "n" th row or last row.

The pixel panel 10 first is operable in a data pre-loading phase, which also corresponds to a previous frame emission phase. As illustrated in FIG. 2, data for the current frame is pre-loaded during the previous frame emission phase. SCAN(1) changes from a low voltage value to a high voltage value, and the DATA line for the column writes the "DATA 1" voltage to the pixel at the first row of the column. SCAN(1) then changes from the high voltage value to the low voltage value, and the "DATA 1" is stored at the first row. SCAN(2) then enables the "DATA 2" to be written and stored at the second row, and so on until the "DATA n" for the nth (last) row is written and stored. When the data pre-loading phase ends, all the data in the current frame has been written and stored in each corresponding pixel in the frame. The previous frame emission phase can still last until the designed emission time.

The pixel panel 10 next is operable in an initialization phase. The global signal GINT changes from a low voltage value to a high voltage value. The pixels in the whole panel start the initialization phase. The GEMI signal remains high through a first or early portion of the initialization phase. At the end of such first portion of the initialization phase, GEMI next changes from a high voltage value to a low voltage value. Thereafter, GIPC changes from a low voltage to a high voltage and thus GIPC is at a high value during a second or latter portion of the initialization phase. The global signals GINT, GEMI, and GIPC are used to clear the data and memory effects from the previous frame and reset the corrected voltage conditions for a next compensation phase of the current frame, as further detailed below.

The pixel circuit 10 next is operable in a combined data transferring and threshold compensation phase. GPRG changes from the low voltage value to the high voltage value and starts the data transfer, which is to apply the data voltage stored during the data pre-loading phase to the drive transistor, and threshold compensation is performed simultaneously for the drive transistors of multiple pixels to all the pixels in the whole display panel. At the end of the data transfer and threshold compensation phase, GIPC and GPRG change from the high voltage value to the low voltage value. The pixel circuit 10 next is operable in an emission phase. GEMI changes from the low voltage value to the high voltage value and starts the emission phase, during which the light-emitting device such as an OLED emits light. As referenced above and as indicated in the timing diagram of FIG. 2, the current frame emission phase also constitutes a data preloading phase as to the next frame.

Details of the four phases globally described in connection with FIGS. 1 and 2 are further understood with the operation of such phases as to each individual pixel circuit. In accordance with embodiments of the present application, an enhanced pixel circuit configuration is provided that enables efficient operation within the global compensation and control scheme described above. In other words, the described individual pixel circuit may be incorporated into each of the individual pixels 14 of the display panel 10. The individual pixel circuit is capable of compensating the threshold voltage variations of the drive transistor with an ultra-short one horizontal time 1H of less than about 2 μs, which is shorter as compared to conventional configurations, with additionally removing the possible memory effects associated with the light-emitting device and drive transistor from the previous frame. An ultra-short 1H time (<2 μs) is achieved via separation of threshold compensation of the drive transistor and data programming phases. The threshold compensation time is decided by the drive transistor characteristics and is difficult to reduce further without degrading the compensation accuracy. By separating the threshold compensation and data programming phases, a longer time can be allocated to threshold compensation for compensation accuracy. As referenced above, the RC constant time required for charging the programming capacitor is determinative of the programming time since data programming is performed separately for each row (whereas the compensation phase can be performed simultaneously for different rows), and such programming time can be reduced to ultra-short 1H times (<2 μs).

To achieve such results, a two-capacitor structure is used, whereby a first capacitor is used for drive transistor threshold compensation, and a second capacitor is used to store the data voltage that has been applied during the data pre-loading phase. The threshold compensation and data programming operations thus are independent of each other, and thus a short one horizontal time can be achieved by employing a short data programming phase. In addition, possible memory effects associated with the OLED device and drive transistor from the previous frame are eliminated by using a dual transistor configuration to electrically connect the gate and source of the drive transistor during the initialization phase, and the initialization voltage is applied at the mid node of the dual transistor configuration. Embodiments of the present application also use an ultra-low leakage oxide transistor, such as an indium gallium zinc oxide (IGZO) transistor, as the data switch device, and this permits the stored data voltage to be retained longer on the second capacitor due to the ultra-low leakage of the ultra-low leakage transistor. As a result, the refresh rate can be reduced as compared to conventional configurations, down to about 30 Hz which is particularly suitable for displaying static images.

Figure 3:
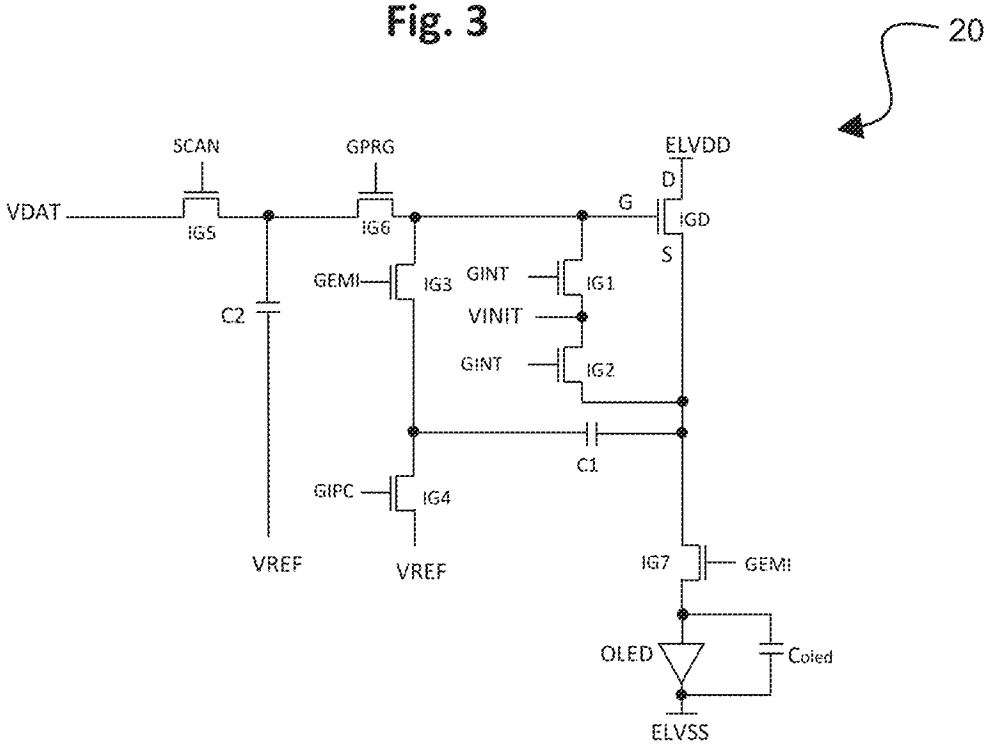
FIG. 3 is a drawing depicting a first pixel circuit configuration in accordance with embodiments of the present application.
Figure 4:
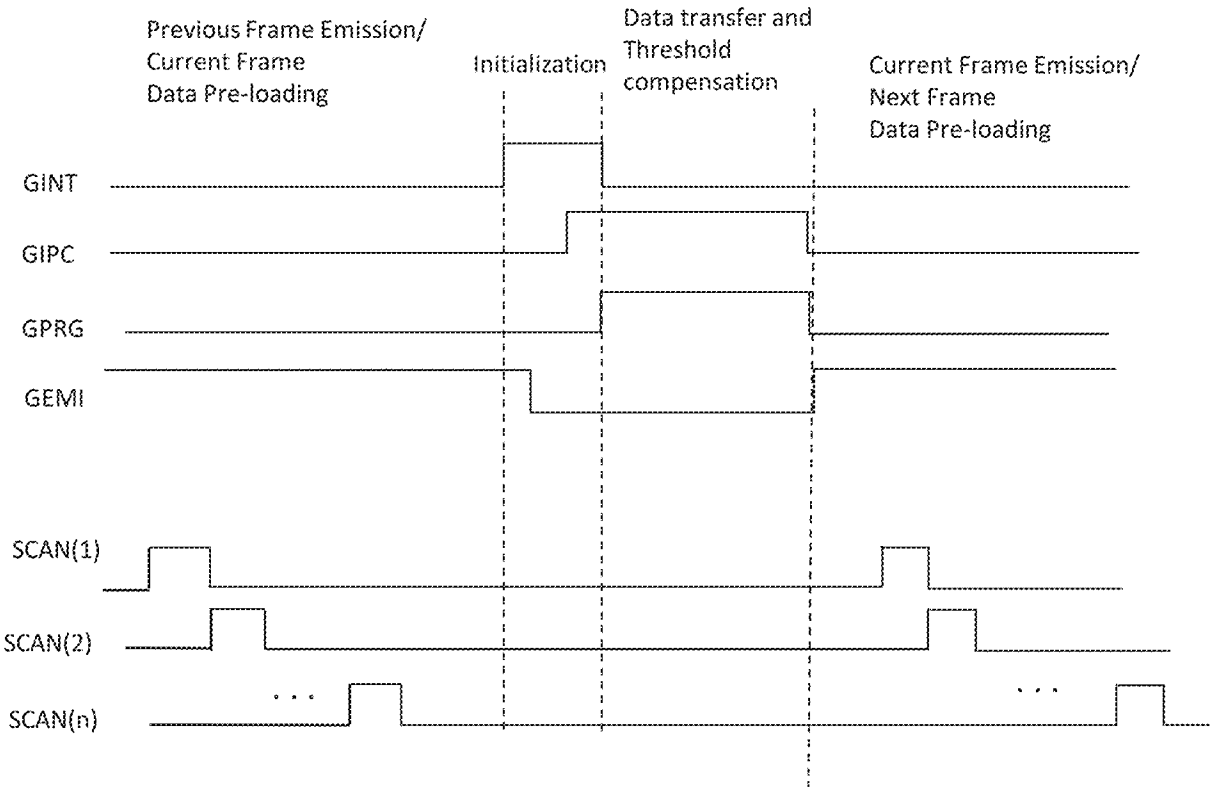
FIG. 4 is a drawing depicting a timing diagram associated with the operation of the circuit of FIG. 3.

FIG. 3 is a drawing depicting an exemplary pixel circuit having a first circuit configuration 20 in accordance with embodiments of the present application, and FIG. 4 is a timing diagram associated with the operation of the circuit configuration 20 of FIG. 3. In this example, the pixel circuit 20 is configured as a thin film transistor (TFT) circuit that includes seven IGZO switch transistors IG1-IG7, one IGZO analogue drive transistor IGD, and two capacitors C1 and C2. In this context, an ultra-low leakage transistor, such as IGZO transistor, is a TFT that has very low leakage current as compared to LTPS (low-temperature polycrystalline silicon) TFTs, and may experience on the order of 1/100th of the leakage current at typical operating conditions. For example, with the same drain-source voltage of 5 volts as is typical for common applications, the off current for an LTPS transistor is normally approximately 1 pA (1E-12) when the device is in an off state, while an ultra-low leakage TFT has a leakage current less than approximately 0.01 pA (1E-14) when the device is in the off state.

The circuit elements drive a light-emitting device, such as for example an organic light-emitting device (OLED). The light-emitting device (OLED) has an associated internal capacitance, which is represented in the circuit diagram as $C_{oled}$. In addition, although the embodiments are described principally in connection with an OLED as the light-emitting device, comparable principles may be used with display technologies that employ other types of light-emitting devices, including for example micro LEDs and quantum dot LEDs.

More specifically, FIG. 3 depicts the pixel circuit 20 configured with multiple IGZO TFTs. Transistor IGD is a drive transistor that is an analogue TFT with the gate, source, and drain labelled ("G", "S", and "D"), and transistors IG1-IG7 are digital switch TFTs. As referenced above, C1 and C2 are capacitors, with C1 also being referred to as the storage capacitor, which stores the data voltage and compensated threshold voltage of the drive transistor, and C2 also being referred to as the data holding capacitor for storing the data voltage during the pre-loading phase. $C_{oled}$ is the internal capacitance of the OLED device (i.e., $C_{oled}$ is not a separate component, but is inherent to the OLED). The OLED further is connected to a power supply line ELVSS as is conventional, and a driving voltage is supplied from a driving voltage supply line ELVDD as also is conventional.

The OLED and the TFT circuit 20, including the transistors, capacitors and connecting wires, may be fabricated using TFT fabrication processes conventional in the art. It will be appreciated that comparable fabrication processes may be employed to fabricate the TFT circuits according to any of the embodiments.

For example, the IGZO TFT circuit 20 (and subsequent embodiments) may be disposed on a substrate such as a glass, plastic, or metal substrate. The IGZO TFT may include a gate electrode, a gate insulating layer, an IGZO layer, a first electrode, and a second electrode. The gate electrode is disposed on the substrate. A gate insulating layer may be disposed on the gate electrode and the substrate. An IGZO layer may be disposed on the gate insulating layer. The first electrode and second electrode may be disposed on the IGZO layer and connected to a metal layer by vias. The first electrode and second electrode respectively may commonly be referred to as the "source electrode" and "drain electrode" of the TFT. The capacitors each may comprise a first electrode, an insulating layer and a second electrode, whereby the insulating layer forms an insulating barrier between the first and second electrodes. Wiring between components in the circuit, and wiring used to introduce signals to the circuit (e.g. SCAN, GINT, GPRG, GEMI, GIPC, VDAT, VINIT, VREF) may comprise metal lines or a doped semiconductor material. For example, metal lines may be disposed between the substrate and the gate electrode of a TFT, and connected to electrodes using vias. The semiconductor layer may be deposited by chemical vapour deposition, and metal layers may be deposited by a thermal evaporation technique.

The light-emitting device, such as an OLED device, may be disposed over the TFT circuit. The OLED device may include a first electrode or terminal (e.g. anode of the OLED), which is connected to transistor IG7 in this example, one or more layers for injecting or transporting charge (e.g. holes) to an emission layer, an emission layer, one or more layers for injecting or transporting electrical charge (e.g. electrons) to the emission layer, and a second electrode or terminal (e.g. cathode of the OLED), which is connected to power supply ELVSS in this example. The injection layers, transport layers, and emission layer may be organic materials, the first and second electrodes may be metals, and all of these layers may be deposited by a thermal evaporation technique.

Referring to the TFT circuit 20 of FIG. 3 in combination with the timing diagram of FIG. 4, the TFT circuit 20 operates to perform in four phases: a data pre-loading phase, an initialization phase, a combined data transfer and threshold compensation phase, and an emission phase for light emission. A global description of these phases was provided in connection with FIGS. 1 and 2 above, and the following describes the operation of such phases as to a single pixel located within the pixel panel. As also referenced above, the time period for performing the data programming is referred to in the art as the "one horizontal time" or "1H" time. A short 1H time is a requirement for displays with a large number of pixels in a column, as is necessary for high-resolution displays. As referenced above, a short one horizontal time is significant because each row must be programmed independently, whereas other operations, such as for example drive transistor threshold compensation, may be performed for multiple rows simultaneously. The responsiveness of the device, therefore, tends to be dictated most by the one horizontal time for programming.

In this embodiment, during a previous frame emission phase, the global emission control signal GEMI has a high voltage level, so transistors IG3 and IG7 are in an on state. The storage capacitor C1 has a first plate connected to the source of the drive transistor, and C1 has a second plate connected to transistor IG3. With IG3 being on, the second plate of C1 is electrically connected to the gate of the drive transistor through IG3. With IG7 being on, the first terminal of the light-emitting device is electrically connected to the source of the drive transistor through IG7, and light emission is being driven by the power supply voltage ELVDD input line connected to the drive transistor IGD, whereby the actual current applied to the OLED is determined by the voltage at the gate and the source of the drive transistor.

During such previous frame emission phase, the global control signal GINT has a low voltage, so transistors IG1 and IG2 are in an off state. The global reference control signal GIPC has a low voltage, so transistor IG4 also is in an off state. The global programming control signal GPRG has a low voltage, so transistor IG6 also is in an off state, and thus the data holding capacitor C2 is electrically isolated from the rest of the pixel circuit. The gate of the drive transistor and the first plate of the storage capacitor C1 are electrically isolated from other circuit portions by ultra-low leakage transistors IG1, IG4 and IG6, which as referenced above are all off. The first plate of the storage capacitor C1 also is electrically isolated by an ultra-low leakage transistor IG2. To implement a global compensation scheme as referenced above in connection with FIGS. 1 and 2, the global control signals, GINT, GIPC, GPRG and GEMI, are applied to multiple pixel circuits simultaneously up to the pixels of the whole pixel panel.

The leakage flowing through such IG transistors is very small when the transistors are off. Accordingly, there typically is only a negligible voltage variation at the storage capacitor C1 during the emission phase. If the display is a static image, the frame rate can be reduced without noticeable degradation to the human eye. The normal frame refresh rate of conventional display configurations is 60 Hz. With the use of ultra-low leakage IGZO transistors as described above, the frame rate can be reduced to 30 Hz or lower. The power consumption of the display thus can be reduced with a lower refresh rate.

The pixel circuit 20 further is operational during a data pre-loading phase, which occurs during the previous frame emission phase. In other words, during the data pre-loading phase all the pixels in the panel emit light during this phase, while the data for the next frame is loading to each pixel row by row. Data switch transistor IG5 is connected at a first terminal to a data voltage supply line that supplies a data voltage VDAT, and at a second terminal to a first (top) plate of the data holding capacitor C2. A first row scan signal SCAN(1) is changed from a low voltage value to a high voltage value, causing the transistor IG5 to be placed in an on state. Turning on IG5 electrically connects the data voltage supply line to the data holding capacitor C2 for supplying the data voltage VDAT. The data voltage VDAT thus is applied at the first plate of the data holding capacitor C2 through IG5. The second plate of the data holding capacitor C2 is connected to a reference voltage supply line that supplies a reference voltage VREF, or any other suitable fixed voltage supply available for the pixel such as ELVDD. The data voltage VDAT is changed from the value for the pixel of the previous row of the display or the last row from the previous frame or a previous value if the row being programmed is a first row, to the data value for the current pixel of the current row, which is applied to the data holding capacitor C2. As the data holding capacitor C2 is electrically isolated from the rest of the pixel circuit by the ultra-low leakage transistor IG6 during the data pre-loading phase, the data voltage stored at the data holding C2 does not affect the emission of the pixel, which is significant as the data pre-loading phase occurs at the same time as emission relative to the previous data value.

At the end of the data pre-loading phase for the first row, the first row scan signal SCAN(1) is changed from the high voltage value to the low voltage value, causing the transistor IG5 to be turned off. With IG5 turning off, the first plate of the data holding capacitor C2 is disconnected from the data voltage supply line, and the data value is stored on the data holding capacitor C2. As IG5 and IG6 are ultra-low leakage transistors, the stored data voltage can be kept on the data holding capacitor C2 during subsequent operational phases without a noticeable change for the duration of the frame.

As seen in the timing diagram of FIG. 4, the second row scan signal SCAN(2) next is enabled to program the data for the pixels for the second row in comparable manner as described above with respect to the first row. The data is programmed row by row until the last row scan signal SCAN(n) is enabled to program the last row "n". When all the data for the frame has been programmed and stored in all the pixels in the panel on such row-by-row basis, the data pre-loading phase ends.

As referenced above, the data pre-loading phase for the current frame occurs within the previous frame emission phase. The data pre-loading phase can start immediately after the start of the previous frame emission phase or with some delay, although the data pre-loading phase should end before the end of the previous frame emission phase. Relatedly, the previous frame emission phase may extend for any suitable duration after the data pre-loading phase for the current frame ends.

After the previous frame emission phase including the current frame data pre-loading phase ends, the pixels next are operable in the initialization phase, whereby multiple pixels up to all pixels in the panel are refreshed and ready for subsequent operational phases. Referring again to the timing diagram of FIG. 4 in connection with the pixel circuit configuration of FIG. 3, at the beginning of the initialization phase, the global control signal GINT signal level is changed from a low voltage value to a high voltage value, and transistors IG1 and IG2 are placed in an on state. In the circuit configuration, a first terminal of the drive transistor is connected to the power supply line ELVDD that supplies the driving voltage. The first switch transistor IG1 has a first terminal connected to the gate of the drive transistor, and a second terminal connected to an initialization voltage supply line that supplies an initialization voltage. The second switch transistor IG2 has a first terminal connected to a second terminal of the drive transistor, and a second terminal connected to the initialization voltage supply line. Accordingly, the initialization voltage is applied at a mid node connection of the second terminal of the first switch transistor and the second terminal of the second switch transistor.

With IG1 being turned on, the gate of the drive transistor IGD is electrically connected through IG1 to the initialization voltage supply line that supplies the initialization voltage VINIT. With IG2 being turned on, the source of the drive transistor IGD is electrically connected through IG2 also to the initialization voltage supply line that supplies the initialization voltage VINIT. The gate and source of drive transistor IGD thus are connected to the same voltage, and thus the drive transistor is turned off and there will be no current flowing from the power supply ELVDD to the light-emitting device during the initialization phase. Turing off the drive transistor IGD during the initialization phase operates to save power.

With IG2 being on, the initialization voltage VINIT also is applied to the first plate of the storage capacitor C1. With IG1 being on and IG3 still being on from the previous emission/data pre-loading phase, the initialization voltage VIN IT also is applied to the second plate of the storage capacitor C1. Any stored voltage across the capacitor C1 is thus cleared and reset. With IG7 and IG2 being on, the initialization voltage VINT also is applied to the first terminal (anode) of the light-emitting device.

During a first or early portion of the initialization phase, the global emission signal GEMI remains high. At the end of such first portion of the initialization phase, the global emission signal GEMI level is changed from a high voltage value to a low voltage value, and transistors IG3 and IG7 are turned off. With IG3 being turned off, the second plate of the capacitor C1 is electrically disconnected from the gate of the drive transistor. With IG7 being turned off, the source of the drive transistor and the first plate of the capacitor C1 are electrically disconnected from the anode of the light emitting device. Next, during a second or latter portion of the initialization phase, the global reference control signal GIPC level is changed from a low voltage value to a high voltage value. The transistor IG4 is thereby placed in an on state, and the second plate of the capacitor C1 is electrically connected to a reference voltage supply line that supplies a reference voltage VREF. In this manner, pertinent circuit voltages are refreshed and ready for subsequent operational phases.

At the end of the initialization phase, the global control signal GINT level is changed from the high voltage value to the low voltage value, and transistors IG1 and IG2 are turned off. The initialization voltage VINIT is a set at a sufficiently low voltage level such that the drive transistor IGD remains off during the initialization phase. The gate and source of the drive transistor are no longer electrically connected to the initialization voltage with IG1 and IG2 being off, and the source of the drive transistor and the first plate of the capacitor C1 are floating.

The TFT circuit 20 next is operable in a combined data transfer and threshold compensation phase. During this phase, the data voltage stored on the data holding capacitor C2 during the previous data pre-loading phase is transferred to the storage capacitor C1, and the threshold voltage of the drive transistor IGD is compensated. For such phase, the global programming control signal GPRG level is changed from a low voltage value to a high voltage value, and transistor IG6 is placed in the on state, which electrically connects the gate of the drive transistor to the first plate of the data holding capacitor C2. In this manner, the data voltage stored on the data holding capacitor C2 is applied to the gate of the drive transistor. The voltage at the first plate of the storage capacitor C1 and the source of the drive transistor is pulled up until such voltage reaches the level of $V_{DAT}-V_{TH}$, where $V_{TH}$ is the threshold voltage of the drive transistor IGD. In this manner, the threshold voltage of the drive transistor and the data voltage effectively are stored on the storage capacitor C1.

Preferably, to have effective voltage threshold compensation of the drive transistor IGD, the initial voltage difference between the source of the drive transistor and the voltage at the gate of the drive transistor, VDAT at the beginning of the current phase, should satisfy the following condition:

$$V_{DAT}-V_{INIT}>V_{TH}+\Delta V,$$

$$V_{INIT}<V_{DAT}-V_{TH}-\Delta V$$

where ΔV is a voltage that is large enough to generate a high initial current to charge the storage capacitor within an allocated threshold compensation time. The value of ΔV will depend on the properties of the transistors. For example, ΔV would be at least 3 volts for exemplary IGZO thin film transistor processes. The initialization voltage VINIT should be set to satisfy these conditions for all the data voltages in the VDAT range.

At the end of the data transfer and threshold compensation phase, the global programming control signal GPRG level is changed from the high voltage to the low voltage, causing transistor IG6 to be turned off. As IG6 is turned off, the gate of the drive transistor is electrically disconnected from the data holding capacitor C2. The global control signal GIPC level also is changed from the high voltage to the low voltage, causing transistor IG4 to be turned off. As IG4 is turned off, the second plate of the capacitor C1 is electrically disconnected from the reference voltage supply line VREF.

The TFT circuit 20 next is operable in an emission phase during which the light-emitting device is capable of emitting light. The global emission signal GEMI is changed from the low voltage value to the high voltage value, causing transistors IG3 and IG7 to be turned on. As the transistor IG3 is turned on, the gate of the drive transistor IGD and the second plate of the storage capacitor C1 are electrically connected. The voltage across the capacitor C1, $V_{REF}-(V_{DAT}-V_{TH})$, is applied to the gate and source of the drive transistor.

As transistor IG7 is turned on, the source of the drive transistor is electrically connected to the first terminal (anode) of the OLED to apply the driving voltage from ELVDD. The current that flows through the OLED is:

$$I_{OLED}=\frac{\beta}{2}(V_{REF}-(V_{DAT}-V_{TH})-V_{TH})^2=\frac{\beta}{2}(V_{REF}-V_{DAT})^2$$

$$\beta=\mu_n\cdot C_{ox}\cdot\frac{W}{L};$$

where $C_{ox}$ is the capacitance of the drive transistor gate oxide;

W is the width of the drive transistor channel;

L is the length of the drive transistor channel (i.e. distance between source and drain); and $\mu_n$ is the carrier mobility of the drive transistor.

Accordingly, the current to the OLED does not depend on the threshold voltage of the drive transistor IGD, and hence the current to the OLED device $I_{OLED}$ is not affected by the threshold voltage variations of the drive transistor. In this manner, variation in the threshold voltage of the drive transistor has been compensated.

During the current frame emission phase, the data pre-loading phase for the next frame also is performed. Accordingly, the data-preloading phase for the next frame starts and ends within the current frame emission phase comparably as described above in connection with data pre-loading of the current frame.

With the operational phases described above, a short one horizontal time 1H is achieved by employing the data pre-loading phase, during which the data voltage VDAT effectively is programmed onto the data holding capacitor C2 during a previous frame emission phase. In this manner, data programming is isolated from the subsequent threshold compensation of the drive transistor to permit reduction of the 1H time. With the data voltage already being programmed to the data holding (second) capacitor C2, the data voltage is readily transferred to the storage (first) capacitor C1 during the threshold voltage compensation. Accordingly, the dual-capacitor configuration isolates the data programming from the threshold voltage compensation to permit the shorter 1H time.

In addition, the dual transistor configuration of IG1 and IG2 is used to electrically connect the gate and source of the drive transistor to the common initialization voltage supply line during the initialization phase to reset circuit voltages for the current frame. The initialization voltage is applied to the mid node connection of the dual transistor configuration, with the initialization voltage being set such that the gate-source voltage of the drive transistor places the drive transistor in an off state. In this manner, no current flows through the drive transistor to the light-emitting device during the initialization phase when the light-emitting device does not emit light, which saves power. The application of the initialization voltage VINIT to the mid node connection of the dual transistor configuration of IG1 and IG2 thus ensures that potential memory effects of a data voltage from a previous frame are eliminated with reduced power consumption.

The pixel circuit 20 operated as described above has several advantages over conventional configurations. As referenced above, the pixel circuit is capable of compensating the threshold voltage variations of the drive transistor while maintaining an ultra-short data programming one horizontal time 1H of less than about 2 μs, which is shorter as compared to conventional configurations, with additionally removing the possible memory effects associated with the OLED device and drive transistor from the previous frame by using the dual transistor configuration of IG1 and IG2 to electrically connect the gate and source of the drive transistor to the initialization voltage during the initialization phase. Separation of the programming and threshold compensation is achieved by using the two-capacitor configuration to separate the threshold compensation and data programming phases, such that a longer time can be allocated to threshold compensation for compensation accuracy while maintaining the ultra-short 1H time. By using ultra-low leakage transistors, such as an IGZO transistor, the refresh rate can be reduced to 30 Hz or lower for static images. With a lower refresh rate, the power consumption in turn is reduced, and power further is reduced by maintaining the drive transistor in the off state during the initialization phase.

The enhanced pixel circuit configuration also enables efficient operation within the global compensation and control scheme described above, and further power saving is achieved by the global compensation scheme. Referring to the display panel operation of FIGS. 1 and 2 in combination with the individual pixel circuit operation of FIGS. 3 and 4, GINT, GIPC, GPRG, and GEMI are common global control signals that are applied to multiple pixel rows, up to all pixel rows in the display panel, simultaneously. This in particular permits the initialization phase, the combined data transfer and threshold compensation phase, and the emission phase to be performed simultaneously for multiple pixels up to all pixels in the display panel, as illustrated for example in the timing diagram of FIG. 2. The data pre-loading phase includes sequentially enabling the SCAN signals to the pixel array row by row of the next frame simultaneously with the emission phase of the current frame for enhanced operational efficiency.

The enhanced pixel circuit configuration also is immune from power supply variations, such as an IR drop from the voltage supply lines. During the data transfer and threshold compensation phase, the stored voltage across the storage capacitor C1 is only related to the data voltage VDAT, the threshold voltage of the drive transistor $V_{TH}$, and the reference voltage VREF. As the reference voltage supply does not supply current to the pixel as the power supply ELVDD supplies the driving voltage, the IR drop is much more reduced for the reference voltage supply line. During the emission phase, as the capacitor C1 is electrically connected between the gate of the drive transistor and the source of the drive transistor, any voltage variations at the ELVDD supply line only affects the drain-source voltage of the drive transistor, which is a secondary effect.

Figure 5:
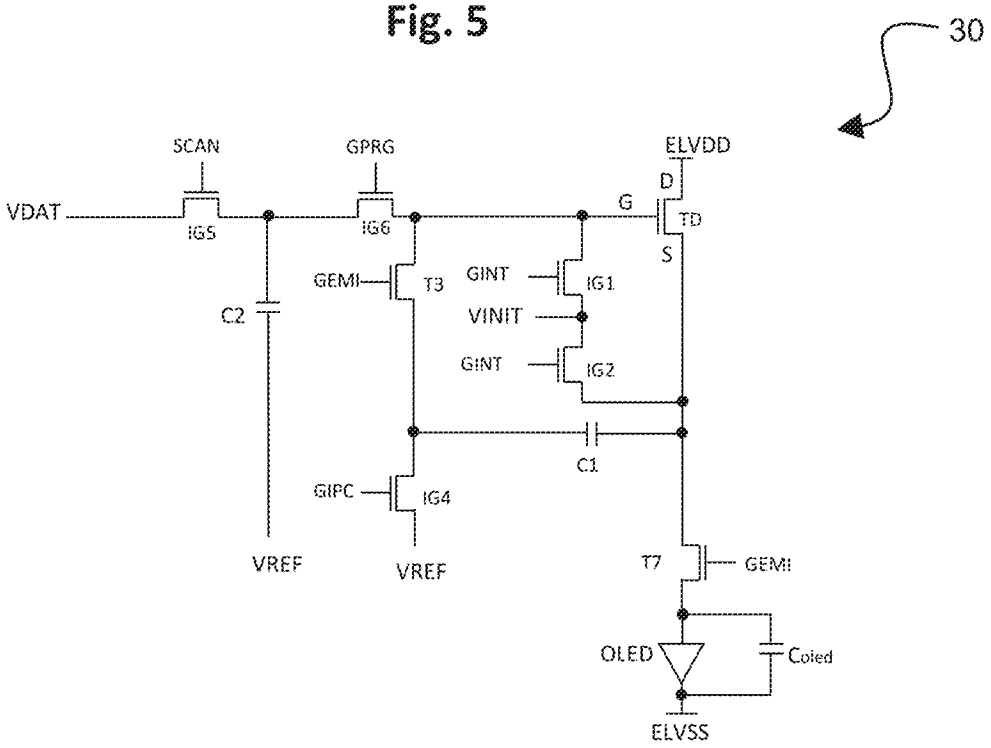
FIG. 5 is a drawing depicting a second pixel circuit configuration in accordance with embodiments of the present application.

FIG. 5 is a drawing depicting an exemplary pixel having a second circuit configuration 30 in accordance with embodiments of the present application. The timing diagram of FIG. 4 associated with the operation of the first circuit configuration 20 of FIG. 3 applies essentially the same as for operation of the second circuit configuration 30 as shown in FIG. 5. The circuit configuration 30 is comparable to the first circuit configuration 20 in many respects with certain modifications. A first difference is that the type of the drive transistor TD is an LTPS TFT in circuit configuration 30 instead of an IGZO TFT as in the circuit configuration 20. The LTPS transistor has higher mobility and can drive a higher current without significantly increasing the size of the transistor, although an IGZO TFT has an advantage of being ultra-low leakage. Similarly, a second difference is that the type of the third and the seventh transistors T3 and T7 also are LTPS TFTs in circuit configuration 30 instead of IGZOs TFT as in the circuit configuration 20. As the LTPS has lower conducting resistance, the same conducting performance as IGZO may be achieved with smaller device sizes, although again IGZO transistors have an advantage of being ultra-low leakage. By using a combination LTPS and IGZO TFTs, the circuit performance may be improved and the circuit size may be reduced, but this is traded off against a potential for increased manufacturing cost and complexity by using two different types of transistors.

An aspect of the invention, therefore, is a pixel circuit for a display device that is configured to place the drive transistor in an off state during initialization for power saving, while still isolating the data programming phase from the compensation phase for a shorter 1H as compared to conventional configurations combined with effective drive transistor threshold voltage compensation. In exemplary embodiments, the pixel circuit includes a drive transistor configured to control an amount of current to a light-emitting device during an emission phase depending upon a voltage applied to a gate of the drive transistor, wherein a threshold voltage of the drive transistor is compensated during a threshold compensation phase, and a first terminal of the drive transistor is connected to a first power supply line that supplies a driving voltage; wherein the light-emitting device is electrically connected at a first node to a second terminal of the drive transistor during the emission phase, and at a second node to a second power supply line; a first switch transistor having a first terminal connected to the gate of the drive transistor, and a second terminal connected to an initialization voltage supply line that supplies an initialization voltage during an initialization phase; and a second switch transistor having a first terminal connected to a second terminal of the drive transistor, and a second terminal connected to the initialization voltage supply line and the second terminal of the first switch transistor. The pixel circuit may include one or more of the following features, either individually or in combination.

In an exemplary embodiment of the pixel circuit, the pixel circuit further includes a data holding capacitor having a first plate that is electrically connectable to the gate of the drive transistor, and a second plate connected to a reference voltage supply line that supplies a reference voltage; and a storage capacitor having a first plate connected to the second terminal of the drive transistor and the first terminal of the second switch transistor, and a second plate that is electrically connectable to the gate of the drive transistor.

In an exemplary embodiment of the pixel circuit, the pixel circuit further includes a third switch transistor having a first terminal connected to the gate of the drive transistor and the first terminal of the first switch transistor, and a second terminal connected to the second plate of the storage capacitor; wherein the second plate of the storage capacitor is electrically connected to the gate of the drive transistor through the third transistor when the third switch transistor is in an on state.

In an exemplary embodiment of the pixel circuit, the pixel circuit further includes a fourth switch transistor having a first terminal connected to the second plate of the storage capacitor and the second terminal of the third switch transistor, and a second terminal connected to a second reference voltage supply line that supplies another reference voltage; wherein the reference voltage is applied to the second plate of the storage capacitor through the fourth switch transistor when the fourth switch transistor is in an on state.

In an exemplary embodiment of the pixel circuit, the pixel circuit further includes a fifth switch transistor having a first terminal connected to the first plate of the data holding capacitor, and a second terminal connected to a data voltage supply line that supplies a data voltage; wherein the first plate of the data holding capacitor is electrically connected to the data voltage supply line through the fifth switch transistor to apply the data voltage to the data holding capacitor when the fifth switch transistor is in an on state.

In an exemplary embodiment of the pixel circuit, the pixel circuit further includes a sixth switch transistor having a first terminal connected to the first plate of the data holding capacitor, and a second terminal connected to the gate of the drive transistor, the first terminal of the first switch transistor, and the first terminal of the third switch transistor; wherein the first plate of the data holding capacitor is electrically connected to the gate of the drive transistor through the sixth switch transistor when the sixth switch transistor is in an on state.

In an exemplary embodiment of the pixel circuit, the pixel circuit further includes a seventh switch transistor having a first terminal connected to the first node of the light-emitting device, and a second terminal connected to the second terminal of the drive transistor and the first plate of the storage capacitor; wherein the first node of the light emitting device is electrically connected to the second terminal of the drive transistor through the seventh transistor when the seventh switch transistor is in an on state.

In an exemplary embodiment of the pixel circuit, the switch transistors are indium gallium zinc oxide transistors.

In an exemplary embodiment of the pixel circuit, a portion of the switch transistors are indium gallium zinc oxide transistors, and a portion of the switch transistors are low-temperature polycrystalline silicon transistors.

In an exemplary embodiment of the pixel circuit, the light-emitting device is one of an organic light-emitting diode, a micro light-emitting diode (LED), or a quantum dot LED.

Another aspect of the invention is a display panel that incorporates an array of individual pixels circuits with a group or global compensation scheme. In exemplary embodiments, the display panel includes a pixel array comprising a plurality of individual pixel circuits arranged in "n" rows by "m" columns, and "n" and "m" are integers greater than one, wherein each of the individual pixel circuits in the pixel array is configured according to any of the embodiments; a common global emission control signal line GEMI that supplies a global emission control signal to multiple individual pixel circuits of the pixel array; a common global initialization control signal line GINT that supplies a global initialization control signal to multiple individual pixel circuits of the pixel array; a common global reference control signal line GIPC that supplies a global reference control signal to multiple individual pixel circuits of the pixel array; and a common global programming control signal GPRG that supplies a global programming control signal to multiple individual pixel circuits the pixel array. The display panel may include one more of the following features, either individually or in combination.

In an exemplary embodiment of the display panel, the common global initialization control signal line GINT supplies the global initialization control signal to the first and second switch transistors of multiple individual pixel circuits of the pixel array; and the initialization voltage is applied at a mid node connection of the second terminal of the first switch transistor and the second terminal of the second switch transistor.

In an exemplary embodiment of the display panel, the display panel includes a common global emission control signal line GEMI that supplies a global emission control signal to the third and seventh switch transistors of multiple individual pixel circuits of the pixel array; a common global initialization control signal line GINT that supplies a global initialization control signal to the first and second switch transistors of multiple individual pixel circuits of the pixel array; a common global reference control signal line GIPC that supplies a global reference control signal to the fourth switch transistors of multiple individual pixel circuits of the pixel array; and a common global programming control signal GPRG that supplies a global programming control signal to the sixth switch transistors of multiple individual pixel circuits the pixel array.

In an exemplary embodiment of the display panel, the display panel further includes scan control signal lines SCAN that supply scan signals to the pixel array, wherein the scan signals are supplied on a row by row basis to sequentially electrically connect data holding capacitors in each of the individual pixel circuits on the row by row basis to the data voltage supply lines to pre-load a respective data voltage onto the data holding capacitors during a data pre-loading phase.

In an exemplary embodiment of the display panel, the display panel further includes scan control signal lines SCAN that supply scan signals to the fifth switch transistors of the individual pixel circuits of the pixel array, wherein the scan signals are supplied on a row by row basis to sequentially electrically connect the data holding capacitors in each of the individual pixel circuits on the row by row basis to the data voltage supply lines to pre-load a respective data voltage onto the data holding capacitors during a data pre-loading phase.

Another aspect of the invention is a method of operating a display panel including a pixel circuit according to any of the embodiments to place the drive transistor in an off state during initialization for power saving, while still isolating the data programming phase from the compensation phase for a shorter 1H as compared to conventional configurations combined with effective drive transistor threshold voltage compensation. In exemplary embodiments, the method of operating the display panel includes the steps of providing a pixel circuit according to any of the embodiments; performing a data pre-loading phase comprising electrically connecting the data holding capacitor to a data voltage supply line that supplies a data voltage to pre-load the data voltage onto the data holding capacitor; performing an initialization phase comprising: placing the first switch transistor in an on state to apply the initialization voltage to the gate of the drive transistor through first switch transistor, and placing the second switch transistor in an on state to apply the initialization voltage to the second terminal of the drive transistor through the second switch transistor, wherein the drive transistor is in an off state when the initialization voltage is applied to the gate and second terminal of the drive transistor; at the end of a first portion of the initialization phase, electrically disconnecting the second plate of the storage capacitor from the gate of the drive transistor and electrically disconnecting the first node of the light-emitting device from the second terminal of the drive transistor; and during a second portion of the initialization phase, applying the reference voltage to the second plate of the storage capacitor; performing a data transfer and threshold compensation phase comprising transferring the data voltage from the data holding capacitor to the gate of the drive transistor, and storing a threshold voltage of the drive transistor at the first plate of the storage capacitor; and performing the emission phase during which light is emitted from the light-emitting device by electrically connecting the second terminal of the drive transistor to the first node of the light emitting device, and electrically connecting the second plate of the storage capacitor to the gate of the drive transistor. The method of operating a display panel may include one or more of the following features, either individually or in combination.

In an exemplary embodiment of the method of operating a display panel, the initialization phase further comprises applying the initialization voltage to a mid node connection of the second terminal of the first switch transistor and the second terminal of the second switch transistor.

In an exemplary embodiment of the method of operating a display panel, the first portion of the initialization phase further comprises placing the third switch transistor in an off state to electrically disconnect the second plate of the storage capacitor from the gate of the drive transistor; and the emission phase further comprises placing the third transistor in an on state to electrically connect the second plate of the storage capacitor to the gate of the drive transistor through the third transistor.

In an exemplary embodiment of the method of operating a display panel, the second portion of the initialization phase further comprises placing the fourth transistor in an on state to electrically connect the second plate of the storage capacitor to the second reference voltage supply line to apply another reference voltage to the second plate of the storage capacitor.

In an exemplary embodiment of the method of operating a display panel, the data pre-loading phase further comprises placing the fifth transistor in an on state to electrically connect the first plate of the data holding capacitor to the data voltage supply line to apply the data voltage to the data holding capacitor through the fifth switch transistor.

In an exemplary embodiment of the method of operating a display panel, the data transfer and threshold compensation phase further comprises placing the sixth transistor in an on state to electrically connect the first plate of the data holding capacitor to the gate of the drive transistor to transfer the data voltage from the data holding capacitor to the gate of the drive transistor through the sixth switch transistor.

In an exemplary embodiment of the method of operating a display panel, the first portion of the initialization phase further comprises placing the seventh switch transistor in an off state to electrically disconnect the first node of light-emitting device from the second terminal of the drive transistor; and the emission phase further comprises placing the seventh transistor in an on state to electrically connect the first node of the light emitting device to the second terminal of the drive transistor through the seventh transistor.

In an exemplary embodiment of the method of operating a display panel, the method further includes arranging a plurality of individual pixel circuits in a pixel array of "n" rows by "m" columns wherein "n" and "m" are integers greater than one; applying a common global emission control signal GEMI to multiple individual pixel circuits of the pixel array during the first portion of the initialization phase, and during the emission phase; applying a common global initialization control signal GINT to multiple individual pixel circuits of the pixel array during the initialization phase; applying a common reference voltage control signal GIPC to multiple individual pixel circuits of the pixel array during the second portion of the initialization phase, and during the data transfer and threshold compensation phase; and applying a common global programming control signal GPRG to multiple individual pixel circuits of the pixel array during the data transfer and programming phase.

In an exemplary embodiment of the method of operating a display panel, the method further includes applying the common global initialization control signal GINT to the first and second switch transistors of multiple individual pixel circuits of the pixel array during the initialization phase.

In an exemplary embodiment of the method of operating a display panel, the method includes applying a common global emission control signal GEMI to the third and seventh switch transistors of multiple individual pixel circuits of the pixel array during the first portion of the initialization phase, and during the emission phase; applying a common global initialization control signal GINT to the first and second switch transistors of multiple individual pixel circuits of the pixel array during the initialization phase; applying a common reference voltage control signal GIPC to the fourth switch transistors of multiple individual pixel circuits of the pixel array during the second portion of the initialization phase, and during the data transfer and threshold compensation phase; and applying a common global programming control signal GPRG to the fifth switch transistors of multiple individual pixel circuits of the pixel array during the data transfer and programming phase.

In an exemplary embodiment of the method of operating a display panel, the method further includes applying a SCAN signal to each row of the pixel array, wherein the SCAN signals are applied on a row by row basis to sequentially electrically connect the data holding capacitors of the individual pixel circuits to the data voltage supply lines on the row by row basis to pre-load a respective data voltage onto the data holding capacitors during the data pre-loading phase.

In an exemplary embodiment of the method of operating a display panel, the method further includes applying SCAN signals to the fifth transistors of each row of the pixel array, wherein the SCAN signals are applied on a row by row basis to sequentially electrically connect the data holding capacitors of the individual pixel circuits to the data voltage supply lines on the row by row basis to pre-load a respective data voltage onto each of the data holding capacitors during the data pre-loading phase.

In an exemplary embodiment of the method of operating a display panel, the data pre-loading phase of a current frame occurs during the emission phase of a previous frame.

Although the invention has been shown and described with respect to a certain embodiment or embodiments, it is obvious that equivalent alterations and modifications will occur to others skilled in the art upon the reading and understanding of this specification and the annexed drawings. In particular regard to the various functions performed by the above described elements (components, assemblies, devices, compositions, etc.), the terms (including a reference to a "means") used to describe such elements are intended to correspond, unless otherwise indicated, to any element which performs the specified function of the described element (i.e., that is functionally equivalent), even though not structurally equivalent to the disclosed structure which performs the function in the herein illustrated exemplary embodiment or embodiments of the invention. In addition, while a particular feature of the invention may have been described above with respect to only one or more of several illustrated embodiments, such feature may be combined with one or more other features of the other embodiments, as may be desired and advantageous for any given or particular application.

INDUSTRIAL APPLICABILITY

Embodiments of the present invention are applicable to many display devices to permit display devices of high resolution with effective threshold voltage compensation and true black performance. Examples of such devices include televisions, mobile phones, personal digital assistants (PDAs), tablet and laptop computers, desktop monitors, digital cameras, and like devices for which a high resolution display is desirable.

REFERENCE SIGNS LIST

10—display panel configuration
12—pixel array
14—individual pixels
16—first panel driver
18—second panel driver
20—first pixel circuit configuration
30—second pixel circuit configuration
IG1-IG7—multiple ultra-low leakage oxide TFT switch transistors
IGD—analogue ultra-low leakage oxide drive transistor
T3, T7—multiple TFT switch transistors
TD—analogue drive transistor
OLED—organic light emitting diode (or generally light-emitting device)
C1—storage capacitor
C2—data holding capacitor
$C_{oled}$—internal capacitance of OLED
VDAT—data voltage supply and supply line
ELVDD—driving voltage supply and supply line
ELVSS—OLED power supply and supply line
VINIT—initialization voltage supply and supply line
VREF—reference voltage supply and supply line
SCAN—row control signals
GINT/GIPC/GEMI/GPRG—group or global control signals

What is claimed is:

1. A method of operating a display panel comprising the steps of:

providing an individual pixel circuit comprising:

a drive transistor configured to control an amount of current to a light-emitting device during an emission phase depending upon a voltage applied to a gate of the drive transistor, and a first terminal of the drive transistor is connected to a first power supply line that supplies a driving voltage;

wherein the light-emitting device is electrically connected at a first node to a second terminal of the drive transistor during the emission phase, and at a second node to a second power supply line;

a first switch transistor having a first terminal connected to the gate of the drive transistor, and a second terminal connected to an initialization voltage supply line that supplies an initialization voltage;

a second switch transistor having a first terminal connected to a second terminal of the drive transistor, and a second terminal connected to the initialization voltage supply line and the second terminal of the first switch transistor;

a data holding capacitor having a first plate that is electrically connectable to the gate of the drive transistor, and a second plate connected to a reference voltage supply line that supplies a reference voltage; and a storage capacitor having a first plate connected to the second terminal of the drive transistor and the first terminal of the second switch transistor, and a second plate that is electrically connectable to the gate of the drive transistor and that is electrically connectable to a reference voltage supply line that supplies the reference voltage;

performing a data pre-loading phase comprising electrically connecting the data holding capacitor to a data voltage supply line that supplies a data voltage to pre-load the data voltage onto the data holding capacitor;

performing an initialization phase comprising:

placing the first switch transistor in an on state to apply the initialization voltage to the gate of the drive transistor through first switch transistor, and placing the second switch transistor in an on state to apply the initialization voltage to the second terminal of the drive transistor through the second switch transistor, wherein the drive transistor is in an off state when the initialization voltage is applied to the gate and second terminal of the drive transistor;

at the end of a first portion of the initialization phase, electrically disconnecting the second plate of the storage capacitor from the gate of the drive transistor and electrically disconnecting the first node of the light-emitting device from the second terminal of the drive transistor; and during a second portion of the initialization phase, applying the reference voltage to the second plate of the storage capacitor;

performing a data transfer and threshold compensation phase comprising transferring the data voltage from the data holding capacitor to the gate of the drive transistor, and storing a threshold voltage of the drive transistor at the first plate of the storage capacitor; and performing the emission phase during which light is emitted from the light-emitting device by electrically connecting the second terminal of the drive transistor to the first node of the light emitting device, and electrically connecting the second plate of the storage capacitor to the gate of the drive transistor.

2. The method of operating a display panel of claim 1, wherein the initialization phase further comprises applying the initialization voltage to a mid node connection of the second terminal of the first switch transistor and the second terminal of the second switch transistor.

3. The method of operating a display panel of claim 1, further comprising:

arranging a plurality of individual pixel circuits in a pixel array of "n" rows by "m" columns wherein "n" and "m" are integers greater than one;

applying a common global emission control signal GEMI to multiple individual pixel circuits of the pixel array during the first portion of the initialization phase, and during the emission phase;

applying a common global initialization control signal GINT to multiple individual pixel circuits of the pixel array during the initialization phase;

applying a common reference voltage control signal GIPC to multiple individual pixel circuits of the pixel array during the second portion of the initialization phase, and during the data transfer and threshold compensation phase;

applying a common global programming control signal GPRG to multiple individual pixel circuits of the pixel array during the data transfer and threshold compensation phase; and applying the common global initialization control signal GINT to the first and second switch transistors of multiple individual pixel circuits of the pixel array during the initialization phase.

4. The method of operating a display panel of claim 1, further comprising applying a SCAN signal to each row of the pixel array, wherein the SCAN signals are applied on a row by row basis to sequentially electrically connect the data holding capacitors of the individual pixel circuits to the data voltage supply lines on the row by row basis to pre-load a respective data voltage onto the data holding capacitors during the data pre-loading phase.

5. The method of operating a display panel of claim 1, wherein the data pre-loading phase of a current frame occurs during the emission phase of a previous frame.

6. The method of operating a display panel of claim 1, wherein the pixel circuit further comprises a third switch transistor having a first terminal connected to the gate of the drive transistor and the first terminal of the first switch transistor, and a second terminal connected to the second plate of the storage capacitor;

wherein the first portion of the initialization phase further comprises placing the third switch transistor in an off state to electrically disconnect the second plate of the storage capacitor from the gate of the drive transistor; and wherein the emission phase further comprises placing the third transistor in an on state to electrically connect the second plate of the storage capacitor to the gate of the drive transistor through the third transistor.

7. The method of operating a display panel of claim 6, wherein the pixel circuit further comprises a fourth switch transistor having a first terminal connected to the second plate of the storage capacitor and the second terminal of the third switch transistor, and a second terminal connected to a second reference voltage supply line;

wherein the second portion of the initialization phase further comprises placing the fourth transistor in an on state to electrically connect the second plate of the storage capacitor to the second reference voltage supply line to apply another reference voltage to the second plate of the storage capacitor.

8. The method of operating a display panel claim 7, wherein the pixel circuit further comprises a fifth switch transistor having a first terminal connected to the first plate of the data holding capacitor, and a second terminal connected to the data voltage supply line that supplies the data voltage;

wherein the data pre-loading phase further comprises placing the fifth transistor in an on state to electrically connect the first plate of the data holding capacitor to the data voltage supply line to apply the data voltage to the data holding capacitor through the fifth switch transistor.

9. The method of operating a display panel of claim 8, wherein the pixel circuit further comprises a sixth switch transistor having a first terminal connected to the first plate of the data holding capacitor, and a second terminal connected to the gate of the drive transistor, the first terminal of the first switch transistor, and the first terminal of the third switch transistor;

wherein the data transfer and threshold compensation phase further comprises placing the sixth transistor in an on state to electrically connect the first plate of the data holding capacitor to the gate of the drive transistor to transfer the data voltage from the data holding capacitor to the gate of the drive transistor through the sixth switch transistor.

10. The method of operating a display panel of claim 9, wherein the pixel circuit further comprises a seventh switch transistor having a first terminal connected to the first node of the light-emitting device, and a second terminal connected to the second terminal of the drive transistor and the second first plate of the storage capacitor;

wherein the first portion of the initialization phase further comprises placing the seventh switch transistor in an off state to electrically disconnect the first node of light-emitting device from the second terminal of the drive transistor; and wherein the emission phase further comprises placing the seventh transistor in an on state to electrically connect the first node of the light emitting device to the second terminal of the drive transistor through the seventh transistor.

* * * * *